US006229428B1

(12) United States Patent
Lai

(10) Patent No.: US 6,229,428 B1
(45) Date of Patent: May 8, 2001

(54) MICROCIRCUIT RESISTOR STACK

(75) Inventor: Gregory Yun Lai, Torrance, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/580,540

(22) Filed: May 30, 2000

(51) Int. Cl.[7] ..... H01C 10/00
(52) U.S. Cl. ..... 338/195; 338/320; 338/295
(58) Field of Search ..... 338/195, 295, 338/320

(56) References Cited

U.S. PATENT DOCUMENTS

| | | | | |
|---|---|---|---|---|
| 3,512,115 | * | 5/1970 | Solow | 338/285 |
| 4,146,867 | * | 3/1979 | Blangeard et al. | 338/195 |
| 4,146,957 | * | 4/1979 | Toenshoff | 338/195 |
| 4,242,660 | * | 12/1980 | Cocca | 338/195 |
| 4,298,856 | * | 11/1981 | Schuchardt | 338/195 |
| 4,584,553 | * | 4/1986 | Tokura et al. | 338/320 |
| 5,065,221 | * | 11/1991 | Imamura | 338/195 |
| 5,196,822 | | 3/1993 | Galluser et al. . | |
| 5,245,145 | | 9/1993 | Freeman et al. . | |
| 6,005,474 | | 12/1999 | Takeuchi et al. . | |
| 6,007,755 | | 12/1999 | Hoshii et al. . | |
| 6,097,276 | * | 8/2000 | VanDenBroek et al. | 338/195 |

FOREIGN PATENT DOCUMENTS

| | | | | |
|---|---|---|---|---|
| 2039920 | * | 2/1972 | (DE) | 338/195 |
| 55-44745 | * | 3/1980 | (JP) | 338/195 |

OTHER PUBLICATIONS

Hoffman, "Quick Trim Aspect Ratio Resistor", V22, No. 5, p1805 (Oct. 1979).*
"Additive Trim of Polymer Thick Film Resistors", V30, No. 4, pp 1571–73 (Sep. 1987).*

* cited by examiner

*Primary Examiner*—Karl D. Easthom
(74) *Attorney, Agent, or Firm*—Mark O. Glut

(57) ABSTRACT

A microcircuit resistor stack, which comprises of at least one set of equal value resistors connected in series providing a course trim, the at least one set of equal value resistors having at least two resistor; and at least one wirebond configuration, the at least one wirebond configuration being able to provide the fine resolution trim of the resistor stack.

12 Claims, 2 Drawing Sheets

MICROCIRCUIT RESISTOR STACK

STATEMENT OF GOVERNMENT INTEREST

The invention described herein may be manufactured and used by or for the Government of the United States of America for governmental purposes without payment of any royalties thereon or therefor. The technology described herein was a subject invention under contract number N00019-96-C-0074 with the Raytheon Company.

BACKGROUND

A resistor is a component of an electric circuit that produces heat while offering opposition, or resistance, to the flow of electricity. A resistor can introduce resistance into an electric circuit. Resistors are primarily used for protection, operation or current control.

In today's high technology electronic environment there is a need to fit a large number of resistors in a narrow space. A large resistor can cause a form-factor problem, especially in a Digital-to Analog Converter (DAC) which is part of an Analog-to-Digital Converter (ADC) Hybrid. The resistor used must be a highly linear resistor as it may be used in converting voltage drive to a current. The linearity requirement places trimming requirements on conventionally fabricated resistors such that the resistor size would adversely affect the form factor of the ADC. Achieving the form factor is critical so that the system resources are not stressed. Most resistors or resistor stacks do not combine a small cross section area and high resolution. To provide higher resolution trims, it is usually necessary to use wider resistors.

For the foregoing reasons, there is a need for a microcircuit resistor stack that fits in a narrow space and can be inexpensively manufactured. Information relevant to attempts to address these problems can be found in U.S. Pat. Nos. 5,196,822, 5,245,145, 6,005,474, and 6,007,755 (None of these patents are admitted to be prior art with respect to the present invention.) However, each of these references suffers from one of the above listed disadvantages.

SUMMARY

The instant invention is directed toward a microcircuit resistor stack that satisfies the needs enumerated above and below.

The object of the present invention is to provide a microcircuit resistor stack, which comprises of a set of equal value resistors connected in series providing a coarse trim, and a wirebond configuration being able to provide the fine resolution trim of the resistor stack. The resistors and wirebond configuration are electrically connected.

The present invention is directed to a microcircuit resistor stack that is a variable value resistor which can be used in hybrid microcircuits where active (laser) trimming is necessary to meet circuit requirements. (Lasers can be used for small scale cutting and welding. They can trim resistors to exact values by removing material within integrated arrays of microcircuit elements.)

It is also an object of the present invention to provide a microcircuit resistor stack that can be configured for high resolution active trimming.

It is also an object of the invention to provide a microcircuit resistor stack that allows a large number of resistors to fit in a narrow space because of narrow resistor width. The microcircuit resistor stack translates a part of the resistor width in the direction of its length.

It is an object of the present invention to provide a hybrid thin film substrate resistor network where each resistor stack has a set of equal value resistors connected in series. Using wirebonds, the value of the resistor stack can be changed. Furthermore if the resistors are over trimmed, second (and third, fourth . . . ) chance resistors are available. Also a less sensitive resistor (higher resolution) can be configured for laser trimming.

It is an object of the invention to provide a microcircuit resistor stack that has a small cross sectional area and high resolution. The microcircuit resistor stack can be compact with very high resolution sections. For hybrid microcircuit high resolution resistor trim applications, multiple microcircuit resistor stacks can be created on a thin film resistor network where space is limited. The microcircuit resistor stack can be used on a high resolution DAC IC circuit. The microcircuit resistor stack is an ideal trim resistor configuration for highly linear DACs.

The present invention provides uniform resistor and conductor dimensions which help the resistor stacks track over temperature. The large variant section can be combined with a high resolution section.

These and other features, aspects and advantages of the present invention will become better understood with reference to the following description and appended claims.

DRAWINGS

DESCRIPTION

Figure 1:
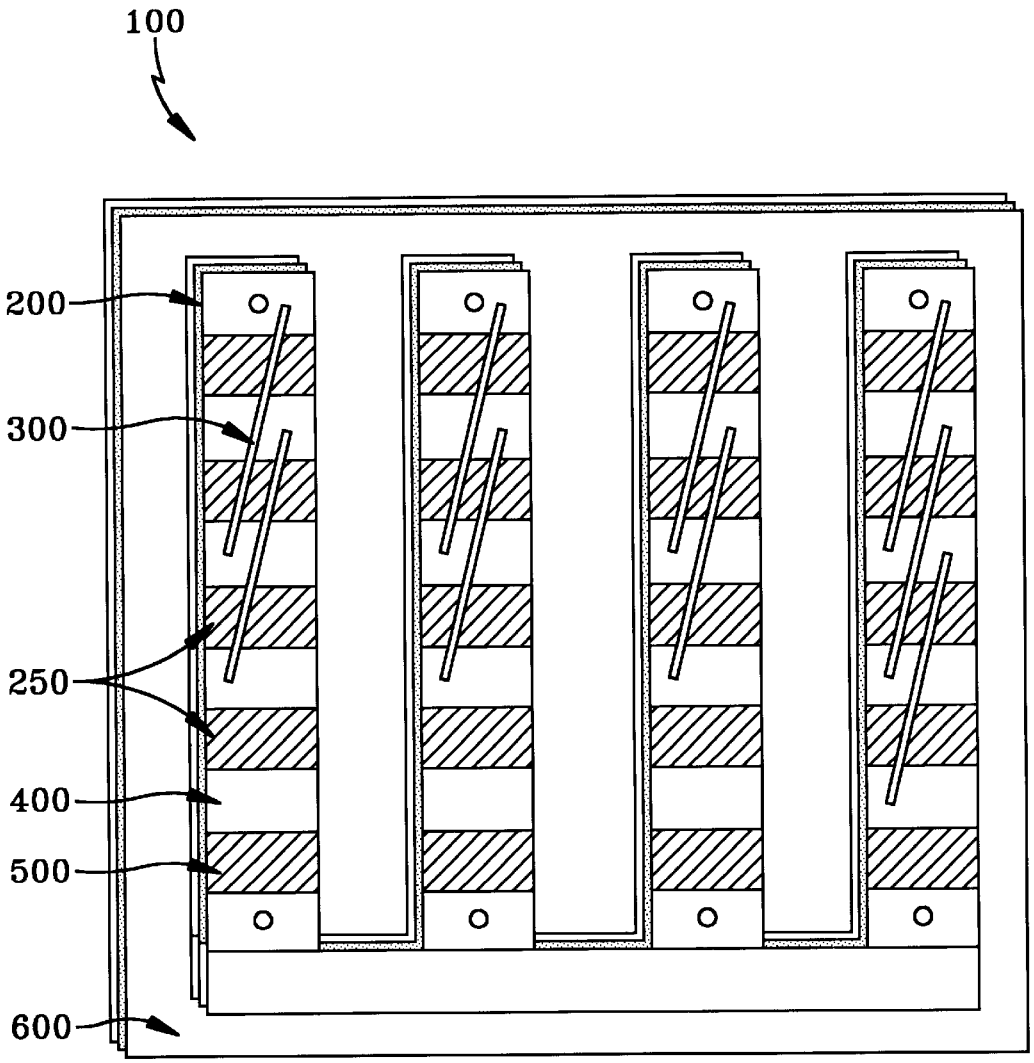
FIG. 1 is a top view of the microcircuit resistor stack.

The preferred embodiment of the present invention is illustrated by way of example in FIG. 1. As shown in FIG. 1, a microcircuit resistor stack 100, comprises of at least one set of equal value resistors 200 connected in series providing a coarse trim and at least one wirebond configuration 300. The at least one set of equal value resistors 200 have at least two resistor 250. If two or more resistors are connected so that all of the electrical charge must traverse all the resistors in succession, then the resistors are in series. The at least one wirebond configuration 300 is able to provide the fine resolution trim of the microcircuit resistor stack 100. The wirebond configuration 300 is electrically connected, associated or related to the at least one set of equal value resistors 200. The at least one wirebond configuration 300 is also physically connected to the at least one set of equal value resistors 200.

The resistance of the microcircuit resistor stack 100 can be controlled by controlling the thickness and length of the microcircuit resistor stack 100. This is done by trimming the various components of the stack. Laser trimming can be used to trim resistors to exact values. Typical high resolution DACs and ADC need to be actively (laser) trimmed to achieve linearity requirements. The fabrication process variations usually determine the linearity limits (without active trimming). As the resolution becomes increased, active trimming becomes necessary. In the design of an active trim resistor network, there are three major concerns: the trim range, the trim resolution and the tracking over the temperature range. Typically there is a trade off between trim range and trim resolution in a single resistor design (one per bit). Therefore, designs sometimes comprise of two resistors. One resistor gives the trim range desired. This is the course trim where the resistor rate of change is the greatest. The other resistor provides a higher resolution trim where the rate of change is smaller that the course trim. The course trim is used to bring the resistance value within trim range of the fine trim resistor. The fine resolution trim is used to obtain a more precise value.

The wirebond configuration 300 may be placed or disposed perpendicular, parallel or at an angle to the at least one set of equal value resistors 200. Repeating the wire bonding pattern as shown in FIG. 1 can create higher resolution trim resistors. The wire-bonding pattern can include the wirebond configuration 300 to be straight, angled or even shaped in the form of a wave or at multiple angles. As shown in FIG. 1, the wirebond configuration 300 can be at an angle to the at least one set of equal value resistors 200. As also shown in FIG. 1, typically each resistor/set of equal value resistors has edges at right angles to each other. As further shown in FIG. 1, to be disposed at an angle to the at least one set of equal value resistors 200, the wirebond configuration 300 cannot be parallel or perpendicular to an edge of the at least one set of equal value resistors 200. The wirebond configuration 200 in FIG. 1 is disposed at a non-parallel and a non-right angle to the edge of the at least on set of equal value resistors 200.

The microcircuit resistor stack 100 also includes at least three contacts, one each on ends of the at least two resistors 250, and one between the at least two resistors 250, serially connecting same. The wirebond configuration 300 completely crosses over the contact between the at least two resistors.

The wirebond configuration 300 can be manufactured from any electropositive chemical element or metal. The wirebond configuration 300 can be made of silver, gold, copper, platinum, bismuth, iron, zinc or any other electropositive chemical element or article including any type of metal alloys. A metal found in the free state (in native ores), especially gold, is optimal because of its relatively low reactivity and high conductivity. The wirebond configuration 300 can be a rolled wire, a conductive rod, a wire strip, a wire created from a die or cast, or several wires interwound or coaxially disposed. The wirebond configuration 300 can also be a spiral winding of wire about a cylindrical ceramic form or around a thin flat card. The wires can be connected together electrically, mechanically or by soldering, bonding or any method of connection, fastening or cohesion. The wirebond configuration 300 can also be a film outlined in the shape of a wire. The film can be a combination of carbon, metal or metal oxide or any electropositive chemical element or article deposited upon a ceramic cylinder. The film can then be coated with an insulating varnish or coating and then a plastic sleeve can be slipped over the resistor to provide mechanical protection.

The at least one set of equal value resistors 200 can have a conductor 400 and a metal resistor 500. The conductor 400 and metal resistor 500 can be made from silver, gold, copper, platinum, bismuth or any other electropositive chemical element or article including any type of alloy. For the conductor 400, gold is preferred, while nickel chromium is preferred for the metal resistor 500. The nickel chromium can have a composition of approximately 80% nickel and 19% chromium, with the balance of the alloy including manganese, silicone and carbon. Nichrome™ is the preferred nickel chromium alloy. Nickel chromium is a high quality resistance heating element material possessing good resistance to oxidation up to about 2100 degrees Fahrenheit.

The at least one set of equal value resistors 200 can be configured on a substrate 600. The substrate 600 can be manufactured from any type of ceramic material, metal, metal alloy, material combined with a metal or any other electropositive chemical element or article. An alumina substrate is preferred. Alumina is the oxide of aluminum that occurs native as corundum and in hydrated forms.

Figure 2:
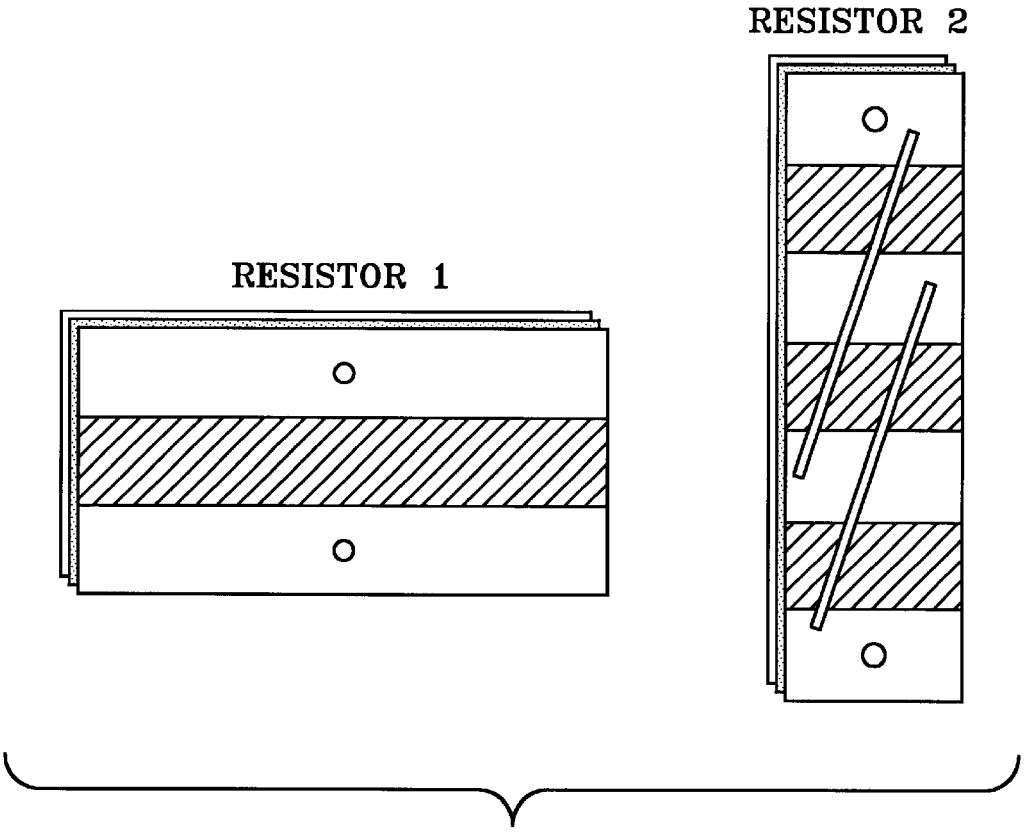
FIG. 2 is a top view of various resistor designs.

The microcircuit resistor stack 100 translates a part of the resistor width in the direction of its length. As shown in FIG. 2, resistor 1 is redesigned as resistor 2 while maintaining the same resistance. Resistor 1 (the conventional resistor design) is three times the width of the redesigned resistor 2 (microcircuit resistor stack). Testing has shown if Resistor 2 in FIG. 2 had no wirebond configuration 300 it would be equal to 150 ohms (3–50 ohm resistors in series) while with the wirebond configuration 300 the resistor value becomes 16.6 ohms, the same as Resistor 1 (also 16.6 ohms). This allows a large number of resistors to fit in a narrow space because of narrow resistor width. This resistor configuration allowed trimming the 8 bit Current summing DAC (part of a hybrid circuit) to a linearity equivalent of 19 bits (an improvement from the previous 14 bit). The microcircuit resistor stack design also allowed 22 (high trim resolution) resistors to be fitted along one side of a DAC Application-Specific Integrated Circuit ("ASIC") where a conventional resistor would have been three times the width of the microcircuit resistor stack.

What is described is only one of many possible variations on the same invention and is not intended in a limiting sense. The claimed invention can be practiced using other variations not specifically described above.

What is claimed is:

1. A microcircuit resistor stack, which comprises:

(a) at least one set of equal value resistors connected in series providing a coarse trim, the at least one set of equal value resistors having at least two resistors;

(b) at least three contacts, one each on ends of the at least two resistors, and one between the at least two resistors, serially connecting same; and (c) at least one wirebond configuration, the at least one wirebond configuration being able to provide the fine resolution trim of the resistor stack, the at least one wirebond configuration electrically and physically connected to the at least one set of equal value resistors, the at least one wirebond configuration completely crossing over at least the contact between the at least two resistors.

2. The microcircuit resistor stack of claim 1, wherein the at least one wirebond configuration is manufactured from an electropositive chemical element.

3. The microcircuit resistor stack of claim 1, wherein the at least one wirebond configuration is manufactured from a metal.

4. The microcircuit resistor stack of claim 3, wherein the at least one wirebond configuration is manufactured from a metal found in a free state.

5. The microcircuit resistor stack of claim 1, wherein the at least one set of equal value resistors connected in series contain a conductor and a metal resistor.

6. The microcircuit resistor stack of claim 5, wherein the conductor and the metal resistor are manufactured from an electropositive chemical element.

7. The microcircuit resistor stack of claim 5, wherein the conductor is manufactured from gold.

8. The microcircuit resistor stack of claim 5, wherein the metal resistor is manufactured from nickel chromium.

9. The microcircuit resistor stack of claim 1, wherein the at least one set of equal value resistors are configured on a substrate.

10. The microcircuit resistor stack of claim 9, wherein the substrate is manufactured from an electropositive chemical element.

11. The microcircuit resistor stack of claim 9, wherein the substrate is an alumina substrate.

12. The microcircuit stack of claim 8, wherein the wirebond configuration is gold, the conductor is gold, the at least one set of equal value resistors is configured on an alumina substrate.

* * * * *

UNITED STATES PATENT AND TRADEMARK OFFICE

CERTIFICATE OF CORRECTION

PATENT NO. : 6,229,428 B1
DATED : May 8, 2001
INVENTOR(S) : Gregory Yun Lai

It is certified that error appears in the above-identified patent and that said Letters Patent is hereby corrected as shown below:

Title page:
Item [75], Inventor's name should be Gregory Yun Lai.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,229,428 B1
DATED : May 8, 2001
INVENTOR(S) : Gregory Yun Lai

It is certified that error appears in the above-identified patent and that said Letters Patent is hereby corrected as shown below:

Title page,
Item [75], Inventor's name should read -- Gregory Yun Lai Au --

This certificate supersedes Certificate of Correction issued August 14, 2001.

Signed and Sealed this

Second Day of April, 2002

*Attest:*

*Attesting Officer*

JAMES E. ROGAN
*Director of the United States Patent and Trademark Office*